US006003870A

United States Patent [19]

Johnson

[11] Patent Number: 6,003,870

[45] Date of Patent: Dec. 21, 1999

[54] HIERARCHICAL METHOD OF PLAYING A CARD GAME

[76] Inventor: Bryson Johnson, 1055 N. 300 West, American Fork, Utah 84003

[21] Appl. No.: 09/130,680

[22] Filed: Aug. 6, 1998

[51] Int. Cl.[6] ..... A63F 1/00

[52] U.S. Cl. ..... 273/306; 273/292; 273/303

[58] Field of Search ..... 273/292, 303–306, 273/308

[56] References Cited

U.S. PATENT DOCUMENTS

| | | | |
|---|---|---|---|
| 357,184 | 2/1887 | Dealy | 273/306 |
| 886,130 | 4/1908 | De Joannis | 273/304 |
| 1,401,001 | 12/1921 | Smiley | 273/306 |
| 1,409,035 | 3/1922 | Smith | 273/306 |
| 1,631,009 | 5/1927 | Clark | 273/306 |
| 5,549,301 | 8/1996 | Gerrard | 273/305 |

OTHER PUBLICATIONS

"Contract Bridge", The Way To Play, by the Diagram Group, Paddington Press Ltd., pp. 90–93, Mar. 1976.

*Primary Examiner*—Benjamin H. Layno

[57] ABSTRACT

A card game is provided including a deck of cards each having four suits. Each suit of cards including cards numbered 2–12, a trump card and a minimum card. The method play of the present invention includes the steps of: designating an order of the players; dealing the cards to each of the players such that each player has an equal amount of cards; and playing a plurality of hands with each hand including the steps of: taking turns between each of the players in the designated order, wherein a card may be played only if its face value is greater than that of the previous card played during the turn, and designating a player who last played a card to be the first to play a card during the next hand.

5 Claims, 1 Drawing Sheet

HIERARCHICAL METHOD OF PLAYING A CARD GAME

BACKGROUND OF THE INVENTION

1. Field of the Invention

The present invention relates to card games and mre particularly pertains to a new hierarchical card game for providing a game during which a leading player is constantly changing.

2. Description of the Prior Art

The use of card games is known in the prior art. More specifically, card games heretofore devised and utilized are known to consist basically of familiar, expected and obvious structural configurations, notwithstanding the myriad of designs encompassed by the crowded prior art which have been developed for the fulfillment of countless objectives and requirements.

Known prior art card games include U.S. Pat. No. 5,106,100; U.S. Pat. No. 5,295,128; U.S. Pat. No. 5,489,101; U.S. Pat. No. Des. 291,330; U.S. Pat. No. 2,063,941; and U.S. Pat. No. Des. 178,662.

In these respects, the hierarchical card game according to the present invention substantially departs from the conventional concepts and designs of the prior art, and in so doing provides an apparatus primarily developed for the purpose of providing a game during which a leading player is constantly changing.

SUMMARY OF THE INVENTION

In view of the foregoing disadvantages inherent in the known types of card games now present in the prior art, the present invention provides a new hierarchical card game construction wherein the same can be utilized for providing a game during which a leading player is constantly changing.

The general purpose of the present invention, which will be described subsequently in greater detail, is to provide a new hierarchical card game apparatus and method which has many of the advantages of the card games mentioned heretofore and many novel features that result in a new hierarchical card game which is not anticipated, rendered obvious, suggested, or even implied by any of the prior art card games, either alone or in any combination thereof.

To attain this, the present invention generally comprises a deck of cards each with a rectangular configuration with a top lace with common indicia printed thereon and a bottom face. The bottom faces of the cards have four suits situated thereon. As shown in FIG. 1, each suit of cards includes cards numbered 2–12. Further a trump card and a minimum card are provided. A unique method of the present invention allows the use of the aforementioned cards such that a person leading is constantly changing, thus affording an exciting game.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention lo provide a new hierarchical card game apparatus and method which has many of the advantages of the card games mentioned heretofore and many novel features that result in a new hierarchical card game which is not anticipated, rendered obvious, suggested, or even implied by any of the prior art card games, either alone or in any combination thereof.

It is another object of the present invention to provide a new hierarchical card game which may be easily and efficiently manufactured and marketed.

It is a further object of the present invention to provide a new hierarchical card game which is of a durable and reliable construction.

An even further object of the present invention is to provide a new hierarchical card game which is susceptible of a low cost of manufacture with regard to both materials and labor, and which accordingly is then susceptible of low prices to sale to the consuming public, thereby making such hierarchical card game economically available to the buying public.

Still yet another object of the present invention is to provide a new hierarchical card game which provides in the apparatuses and methods of the prior art some of the advantages thereof, while simultaneously overcoming some of the disadvantages normally associated therewith.

Still another object of the present invention is to provide a new hierarchical card game for providing a game during which a leading player is constantly changing.

Even still another object of the present invention is to provide a new hierarchical card game that includes a deck of cards each having four suits. Each suit of cards including cards numbered 2–12, a trump card and a minimum card. The method play of the present invention includes the steps of: designating an order of the players; dealing the cards to each of the players such that each player has an equal amount of cards; and playing a plurality of hands with each hand including the steps of: taking turns between each of the players in the designated order, wherein a card may be played only if its face value is greater than that of the previous card played during the turn, and designating a player who last played a card to be the first to play a card during the next hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
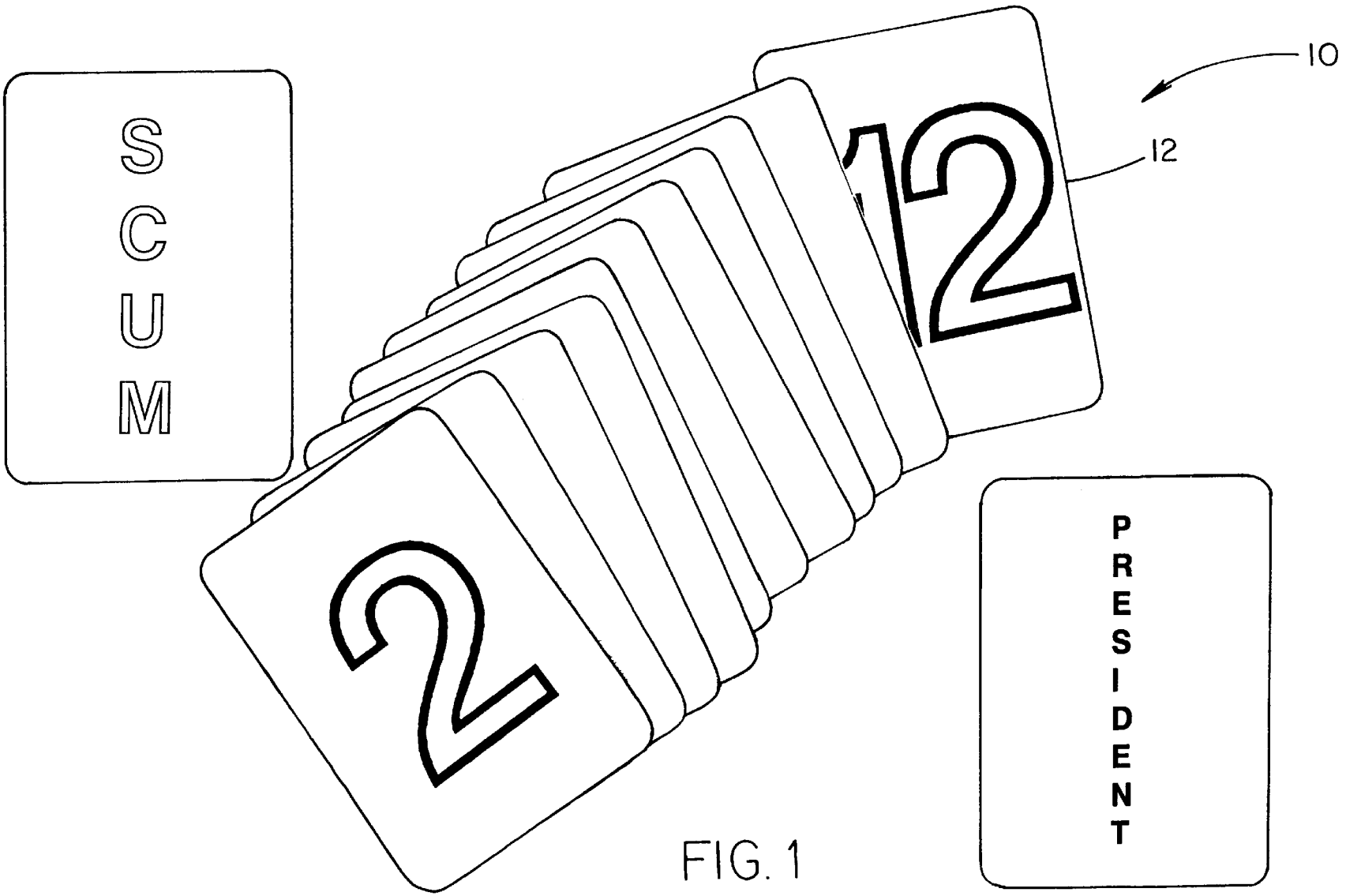
FIG. 1 is a top view of the deck of cards of the present invention.

With reference now to the drawings, and in particular to FIG. 1 thereof, a new hierarchical card game embodying the principles and concepts of the present invention and generally designated by the reference numeral 10 will be described.

The present invention, designated as numeral 10, includes a deck of cards 12 each with a rectangular configuration having a top face with common indicia printed thereon and a bottom face. The bottom faces of the cards have four suits situated thereon. As shown in FIG. 1, each suit of cards includes cards numbered 2–12. Further, a trump card and a minimum card are provided. The trump card preferably has "President" indicia situated thereon and the minimum card preferably has "Scum" indicia positioned thereon. It should be noted that the minimum card is designated as the lowest in the deck. In the preferred embodiment, the deck of cards further includes 2 wild trump cards.

The method of the present invention will now be set forth. To carry out such method, at least five players are provided. Preferably six players are employed. If only five players are included, however, one of the minimum cards, a card with a number 2 thereon, and two trump cards must be removed for optimal play.

Prior to the beginning of a first game, the players are designated in a predetermined order. Such order and associated designations are preferably as follows: President, Vice President, Middle Class #1, Middle Class #2, Next-to-Scum, and Scum. The orders of the players may initially determined by any means such as a coin, straws, high card, or the like.

Once the order is established, the cards are dealt to each of the players such that each player has an equal amount of cards. Next, the cards are traded between pairs of players. During Such trading, the President trades ally two cards to Scum and Scum trades two highest cards to President. The Vice President does the same with the Next-to-Scum, but only with one card. Limits or restrictions may be made regarding trading if desired.

After trading is complete, a plurality of hands are played. Each of such hands entails the players taking turns in the designated order. The first turn is started by the President and is followed by the Vice President, and so on until each player has a single chance to play. It is a rule that each player may play a card only if its face value is greater than that of the previous card played during the turn. If the player who first plays a card plays a pair, each of the following players must play a pair that is greater than the previous pair. During each turn, if any player is unable to play a card in accordance with the foregoing rules, her or she must pass. It should be noted that the trump card may be played in any circumstance regardless of what card is previously played.

Each turn of the hand ends with a player last able to play a card being designated as the first to play a card during the next hand. Despite who plays first, the players play in the order set forth at the beginning of the game. For example, if a hand is to be started with the player designated as Next-to-Scum, Scum would play next after which the President, Vice President would play and so on.

The objective during the hand is to get rid of all of a player's cards. The order for the next game is governed by what order the players use all of their cards. For example, if a player gets rid of each of his or her cards first, second, or third, his or her designation for the next game is President, Vice President, or Middle Class #1, respectively. Further at the end of each game, a number of points are awarded to each player depending on how he or she finished. Such award schedule is as follows:

President: 6pts.

Vice President: 5pts.

Middle Class #1: 4pts.

Middle Class #2: 3pts.

Next-to-Scum: 2pts.

Scum: 1pt.

The next game starts in the new order with the cards being dealt and trading ensuing. Games are played until one of the players reaches 40 points and being declared a winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, Since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game comprising the steps of:

providing a deck of cards each with a rectangular configuration with a top face with common indicia printed thereon and a bottom face, the bottom face of the cards having four suits, each suit of cards including cards numbered 2–12, a trump card and a minimum card, wherein the deck of cards further includes 2 wild trump cards;

providing at least five players;

removing one of the minimum cards, a card with a number 2 thereon, and two trump cards if only five players are provided;

designating an order of the players;

dealing the cards to each of the players such that each player has an equal amount of cards;

trading cards between pairs of players;

playing a plurality of hands with each hand including the steps of:

taking turns between each of the players in the designated order, wherein a card may be played only if its face value is greater than that of the previous card played during the turn, and designating a player who last played a card to be the first to play a card during the next hand; and designating a new order of players for the next game as a function of which players use all of their cards first.

2. A method of playing a game comprising the steps of:

providing a deck of cards each having multiple suits, each suit of cards including cards and a trump card;

designating an order of the players;

dealing the cards to each of the players such that each player has an equal amount of cards; and playing a plurality of hands with each hand including the steps of:

taking turns between each of the players in the designated order, wherein a card may be played only if its face value is greater than that of the previous card played during the turn, and designating a player who last played a card to be the first to play a card during the next hand.

3. A method of playing a game as set forth in claim 1 wherein the steps further include designating a new order of players for the next game as a function of which player uses all of their cards first.

4. A method of playing a game as set forth in claim 1 wherein the deck of cards further includes 2 wild trump cards.

5. A method of playing a game as set forth in claim 1 wherein if only five players are provided, the steps further include removing one of the minimum cards and a card with a number 2 thereon.

* * * * *